United States Patent [19]

Dancer

[11] Patent Number: 4,890,958

[45] Date of Patent: Jan. 2, 1990

[54] RAILROAD CABLE/PIPE PLOW AND METHOD THEREFOR

[76] Inventor: Jerry N. Dancer, 821 Rockefeller Rd., Adrian, Oreg. 97901

[21] Appl. No.: 297,332

[22] Filed: Jan. 17, 1989

[51] Int. Cl.[4] ..... F02F 5/10

[52] U.S. Cl. ..... 405/180; 37/105; 37/84; 37/193

[58] Field of Search ..... 37/84, 98, 193, 195, 37/104, 105; 405/174, 180; 104/2

[56] References Cited

U.S. PATENT DOCUMENTS

| | | | |
|---|---|---|---|
| 1,158,979 | 11/1915 | Bunnell | 37/84 |
| 1,455,494 | 5/1923 | Johnson | 37/105 |
| 3,308,628 | 3/1967 | Nichols | 37/193 |
| 3,380,180 | 4/1968 | Speno | 37/105 |
| 3,546,887 | 12/1970 | Helmus | 405/180 |
| 3,905,200 | 9/1974 | Ylinen | 37/193 X |
| 4,357,129 | 11/1982 | Luttig | 37/104 X |

*Primary Examiner*—Dennis L. Taylor
*Assistant Examiner*—Arlen L. Olsen
*Attorney, Agent, or Firm*—Frank Dykas; Craig Korfanta

[57] ABSTRACT

A railroad right-of-way trench plowing machine which includes a locomotive 11, standard flat car 12, a hydraulic boomed vehicle, such as a backhoe 13, attached to flat car 12, a steerable plowing blade 15 attached to the hydraulic boom 16 and a cable 14 attached at one end to the plowing blade 15 and the other end to the locomotive 11. The plowing blade 15 is pivotally attached to hydraulic boom 16 and has tooth 29 located at its bottom end, foot 28, which is disposed to point in the direction to be trenched. A cable guide 17, consisting of a J-shaped tube, is attached to trailing edge 26 of vertical blade 18 and is disposed such that utility cable 1, fed into the top end of cable guide 17, is automatically directed to the base of the trench.

An optional feature provides a hydraulic ram 30 attached between pivoting blade 18 and the hydraulic boom 16 for hydraulically pivoting blade 18 about boom 16. Hydraulic ram 30 provides additional steering capabilities.

11 Claims, 4 Drawing Sheets

15

RAILROAD CABLE/PIPE PLOW AND METHOD THEREFOR

BACKGROUND OF THE INVENTION

1. Technical Field

This invention generally relates to machines for digging trenches adjacent railroad tracks and in particular to a machine and method for plowing a deep trench, for the installation of cable or pipe therein, adjacent the ballast of the railroad track.

2. Background Art

As far back as the early 1900's, ballast trenching machines have been used to periodically remove and replace the ballast of the railroad track bed. Typical of these machines are BUNNELL, U.S. Pat. No. 1,158,979, SPENO, U.S. Pat. No. 3,380,180 and JOHNSON, U.S. Pat. No. 1,455,494.

Bunnell teaches a railroad trenching machine designed for digging a trench in the ballast directly adjacent the railroad track. The invention consists of a railroad car having a conveyor belt type excavator attached to one side. Two major disadvantages to the excavator of Bunnell are first, the excavator is capable of trenching only within about three feet of either rail, and second, the machine can only be transported from excavation site to excavation site by rail.

Speno teaches a similarly located plurality of plowing tools for scarifying the ballast material directly adjacent the ends of the railroad ties. Speno's device is not capable of plowing deep trenches. Additionally, Speno's device is limited to trenching only in the ballast area, which is immediately adjacent the railroad track.

Johnson teaches a ditching machine which is capable of plowing trenches at greater distances away from the track and ballast. The device has a hinged rack which can be lowered into a coplanar position with the top of a railroad flat car and which trenching or plowing implements depend therefrom.

In laying utility lines, such as communication cables and the like, it is necessary to bury the cables at least three feet below ground surface, preferably 5–10 feet away from the track and ballast. It should be appreciated, that in plowing a three foot deep trench, great resistive forces are encountered. In fact, so great are these resistive forces that the moment created about the flat car actually distorts, loosens and bends the rails of the railroad track, using devices similar to that taught by Johnson. This moment is further exaggerated by the long moment arm necessary to plow trenches 5–10 feet away from the track.

Additional disadvantages to the device taught by Johnson include the lack of transportability of the specialized flat car and the non-steerable plow blades. While the plow blades of Johnson do appear to be depth adjustable, once adjusted they cannot be steered or easily readjusted to maneuver around an obstacle located along the railroad right-of-way.

Most utility line installers prefer not to use or own specialized railroad trenching cars. Obviously, this is because the railroad cars have to be transported by rail from excavation to excavation site and they must be stored in a rail yard when not in use. Most utility line installers use standard road excavation equipment when installing utility lines along railroad right-of-ways. This creates a substantial problem for the installer when faced with a narrow railroad right-of-way, such as those commonly found in mountainous areas and river valleys which do not have access roads or adequate working room beside the railroad track. The end result is that the utility line installation contractor must charge the utility companies, and ultimately the consumer higher prices to cover the costs of renting specialized equipment.

What is needed is a cost efficient apparatus and method for installing utility lines along railroad right-of-ways, be they narrow, wide or otherwise.

It is therefore an object of the present invention to provide a plowing apparatus for plowing trenches and method therefor, which is easily transported, cost efficient, does not interfere with the integrity of the railroad track rails and further does not require special railroad vehicles.

DISCLOSURE OF INVENTION

These and other objects are accomplished using a locomotive, standard flat car, a hydraulic boomed vehicle, such as a backhoe, attached to the flat car, a steerable plow blade attached to the hydraulic boom and a cable attached at one end to the plow blade and the other end to the locomotive. The plow blade is pivotally attached to the hydraulic boom and has a tooth located at its bottom end which is disposed to point in the direction to be plowed. A cable guide, consisting of a J-shaped tube, is attached to the trailing edge of the vertical blade and is disposed such that cable fed into the top end of the guide is automatically directed to the base of the trench.

An optional feature includes a hydraulic ram attached between the pivoting blade and the hydraulic boom for hydraulically pivoting the blade about the boom. The hydraulic ram provides additional steering capabilities.

In use, the boom operator engages the vertical blade with the ground at the appropriate distance away from the railroad track. The locomotive engineer then puts the locomotive in forward motion while the boom operator lowers the blade into the plowing position to begin plowing. The boom operator can then maneuver the boom to navigate around obstacles in the trench path. Also, the optional hydraulic pivot ram can be directly controlled by the boom operator to facilitate steering of the plowing blade.

The cable attached between the locomotive and the plowing blade tensively distributes the plowing resistance force to the locomotive, thereby greatly reducing the moment about the flat car. The cable allows a utility line installer to plow from a standard flat car using an extended moment arm without affecting the integrity of the track rails. Obviously, this enables the utility line contractor a great advantage in that a utility line trench can be economically installed essentially anywhere within the railroad right-of-way regardless of other vehicle access and without expensive specialized equipment.

BEST MODE FOR CARRYING OUT INVENTION

Figure 1:
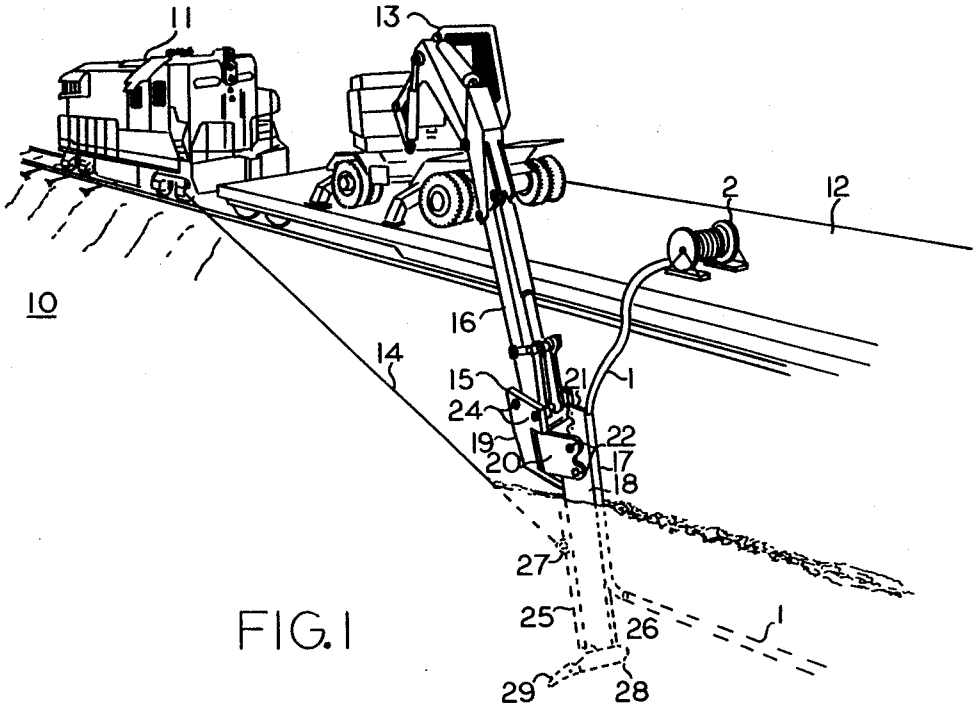
FIG. 1 is a perspective view of a machine for plowing trenches and laying utility lines beside a railroad track.

A machine for plowing trenches and laying utility line therein, beside a railroad track, is shown in FIG. 1 and is hereinafter referred to as railroad pipe/cable plow 10. Railroad pipe/cable plow 10 here consists of locomotive 11 coupled with a railroad flat car 12 having a backhoe 13 thereon. Backhoe 13 is securely attached to flat car 12 and merely provides flat car 12 with a hydraulic boom, here designated as 16. Hydraulic boom !6 has plowing tool 15 attached at its end. Cable 14 has one of its ends attached to plowing tool 15 and the other of its ends attached to locomotive 11. "J"-shaped utility cable guide 17 is attached to trailing edge 26 of plowing tool 15 for guiding utility cable 1 from spool 2 into the trench plowed by railroad pipe/cable plow 10.

Figure 2:
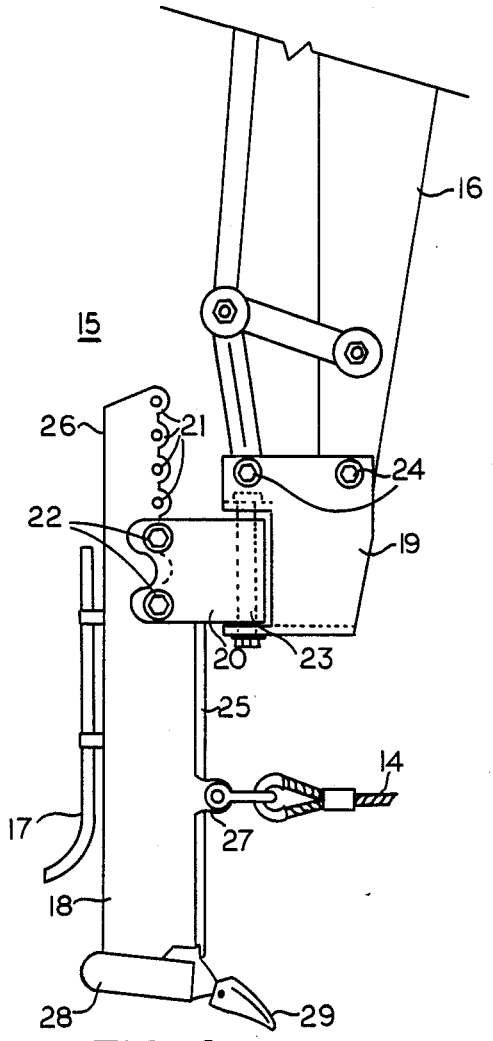
FIG. 2 is a side view of a first embodiment of a plowing tool, which forms a part of the machine of FIG. 1.

FIG. 2 shows plowing tool 15 attached to hydraulic boom 16. Plowing tool 15 has vertical blade 18 attached to pivotal blade bracket 20. Pivotal blade bracket 20 is pivotally attached to boom bracket 19. Vertical blade 18 has depth adjustment holes 21 disposed along the upper end of bevelled leading edge 25. Vertical blade 18 is secured to pivotal blade bracket 20 by blade adjustment bolts 22.

Vertical blade 18 has bevelled leading edge 25 which is advantageously constructed of a hard steel and welded thereto. "J"-shaped utility guide 17 is affixed to trailing edge 26 and further disposed to guide utility cable into the trench created by plowing tool 15. Cable eyelet 27 is secured to bevelled leading edge 25 and provides an attachment point for cable 14.

Foot 28 is attached to the bottom end of vertical blade 18 and is adapted to receive replaceable hard steel tooth 29.

Figure 3:
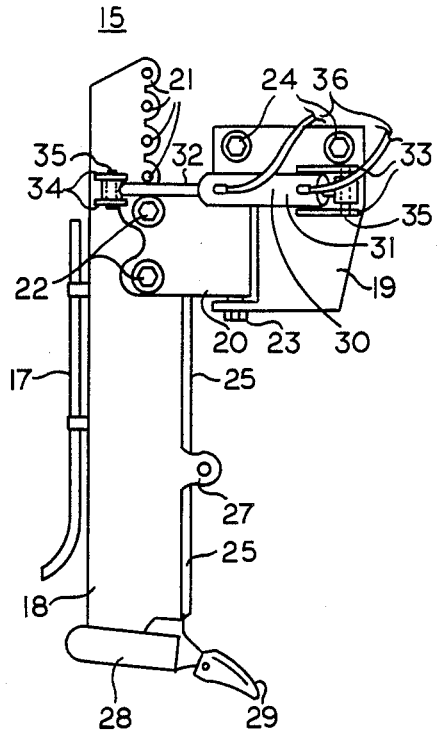
FIG. 3 is a side view of a second embodiment of a plowing tool.

Referring now to FIG. 3 a second embodiment of plowing tool 15 is shown which provides a hydraulic ram 30. Hydraulic ram 30 enables a boom operator to steer plowing tool 15 by pivoting vertical blade !8 about main pivot pin 23. Both piston cylinder 31 and connecting rod 32 are pivotally attached at their connecting points. Piston cylinder 31 is pivotally attached to cylinder bracket 33 by a pivot pin 35, while connecting rod 32 is pivotally attached to connecting rod bracket 34 by another pivot pin 35. Auxiliary hydraulic lines 36 provide a hydraulic coupling between the boom controls and hydraulic ram 30.

Figure 4:
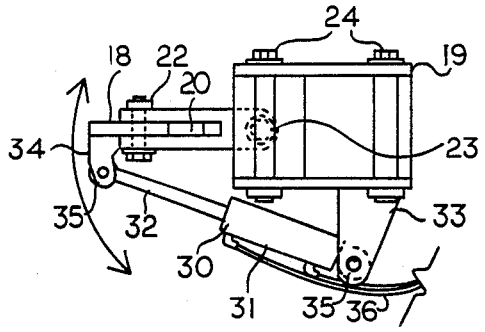
FIG. 4 is a top plan view of the second embodiment plowing tool.

FIG. 4 illustrates the pivotal connections of boom bracket 19 with pivotal blade bracket 20 and hydraulic ram 30 with cylinder bracket 33 and connecting rod bracket 34, in greater detail. A pair of boom connecting pins 24 serve as a static couple between boom bracket 19 and a standard hydraulic boom.

In use, boom operator lowers hydraulic boom 16 into a plowing position on the railroad right-of-way beside flat car 12. Locomotive 11 is then engaged in a forward direction while the boom operator continues to lower plowing tool 15, engaging tooth 29 with the ground. Plowing tool 15 is continued to be lowered until it reaches the appropriate depth, at which time utility cable can be fed through "J"-shaped cable guide 17 and laid within the trench created by plowing tool 15. Cable 14 is maintained in a tensed state between plowing tool 15 and locomotive 11, thereby tensively distributing the resistive forces to the locomotive encountered while plowing. This drastically reduces the moment created about flat car 12 by the extended moment arm of hydraulic boom 16 and eliminates the distortion of the track rails encountered heretofore.

While there is shown and described the present preferred embodiment of the invention, it is to be distinctly understood that this invention is not limited thereto but may be variously embodied to practice within the scope of the following claims.

I claim:

1. A plowing tool for attachment to a hydraulic boomed vehicle being secured to a railed railroad car which is in turn coupled to a railed locomotive, which comprises:
   - a vertical blade having a leading edge and a trailing edge;
   - pivotal attachment means for attaching said vertical blade to a hydraulic boom; and
   - a cable secured at its first end to said vertical blade and at its second end to the locomotive for reducing a moment about a connection between the rails and the railroad car which is due to a moment about the attached boomed vehicle created while plowing.

2. The plowing tool of claim 1 further comprising a cable guide secured to the trailing edge of said vertical blade for guiding cable into a trench created by said vertical blade.

3. The plowing tool of claim 2 further comprising a hydraulic ram operably attached to said vertical blade and the hydraulic boom for pivotally displacing said vertical blade with respect to the hydraulic boom.

4. The plowing tool of claim 1 further comprising a hydraulic ram operably attached to said vertical blade and the hydraulic boom for pivotally displacing said vertical blade with respect to the hydraulic boom.

5. A machine for plowing trenches and laying utility lines beside a railroad track which comprises:
   - a railed locomotive;
   - a railed railroad car coupled to said locomotive;
   - a hydraulic boom secured to said railroad car;
   - a plowing tool attached to said hydraulic boom; and
   - a cable secured at a first end to said plowing tool and at a second end to said locomotive for reducing a moment about said railroad car created while plowing.

6. The machine of claim 5 wherein said plowing tool comprises:
   - a vertical blade having a leading edge and a trailing edge; and
   - pivotal attachment means for attaching said vertical blade to the hydraulic boom.

7. The plowing tool of claim 6 further comprising a cable guide secured to the trailing edge of said vertical blade for guiding cable into a trench created by said vertical blade.

8. The plowing tool of claim 7 further comprising a hydraulic ram operably attached to said vertical blade and said hydraulic boom for pivotally displacing said vertical blade with respect to said hydraulic boom.

9. The plowing tool of claim 5 further comprising a hydraulic ram operably attached to said vertical blade and said hydraulic boom for pivotally displacing said vertical blade with respect to said hydraulic boom.

10. The plowing tool of claim 5 further comprising a cable guide secured to said vertical blade for guiding cable into a trench created by said vertical blade.

11. A method for burying utility lines beside a railroad track comprising the steps of:
   - securing a hydraulic boom to a railroad car;
   - laterally displacing a first end of the hydraulic boom;

attaching a plowing tool to the first end of the hydraulic boom;

securing the plowing tool by a cable to a locomotive coupled to the railroad car;

engaging the plowing tool with the ground beside the railroad track;

plowing a trench beside the railroad track by advancing the locomotive, railroad car, hydraulic boom and plowing tool along the railroad track; and laying the utility line in the trench created behind the plowing tool.

* * * * *